US005149910A

United States Patent [19]

McKee

[11] Patent Number: 5,149,910

[45] Date of Patent: Sep. 22, 1992

[54] POLYPHASE ARMOR WITH SPOILER PLATE

[75] Inventor: Gregg L. McKee, San Jose, Calif.

[73] Assignee: FMC Corporation, Chicago, Ill.

[21] Appl. No.: 532,815

[22] Filed: Mar. 8, 1966

[51] Int. Cl.[5] ..... F41H 5/04; F41H 7/04

[52] U.S. Cl. ..... 89/36.02; 89/36.08; 109/82

[58] Field of Search ..... 89/36, 36 A, 36 T, 36.5, 89/36.8, 36.01, 36.02, 36.08, 36.11, 36.04; 109/29, 49.5, 58, 78, 80, 82, 84

[56] References Cited

U.S. PATENT DOCUMENTS

| | | | |
|---|---|---|---|
| 787,065 | 4/1905 | White | 89/36 A UX |
| 1,312,371 | 8/1919 | Tritton | 89/36 A |
| 1,317,428 | 9/1919 | Cavicchi | 89/36 UX |
| 1,745,299 | 1/1930 | Holan | 89/36 X |
| 2,316,055 | 4/1943 | Davey | 89/36 |
| 2,318,301 | 5/1943 | Eger | 89/36 A UX |
| 2,382,862 | 8/1945 | Davis | 89/36 T |
| 2,391,353 | 12/1945 | Sheridan | 89/36 A UX |
| 2,871,763 | 2/1959 | Blomquist | 89/36 T |

FOREIGN PATENT DOCUMENTS

| | | | |
|---|---|---|---|
| 76823 | 8/1948 | Czechoslovakia | 89/36 |
| 302458 | 9/1921 | Fed. Rep. of Germany | 89/36 |
| 913188 | 8/1946 | France | 89/36 |
| 1743 | of 1877 | United Kingdom | 89/36 |
| 9830 | of 1901 | United Kingdom | 89/36 A |

*Primary Examiner*—Stephen C. Bentley

*Attorney, Agent, or Firm*—A. J. Moore; R. C. Kamp; R. B. Megley

[57] ABSTRACT

Composite armor comprising a corrugated metal spoiler plate in front of and spaced from high alumina ceramic tiles backed by an aluminum anvil.

2 Claims, 3 Drawing Sheets

INVENTOR
GREGG L. MC KEE

FIG_5
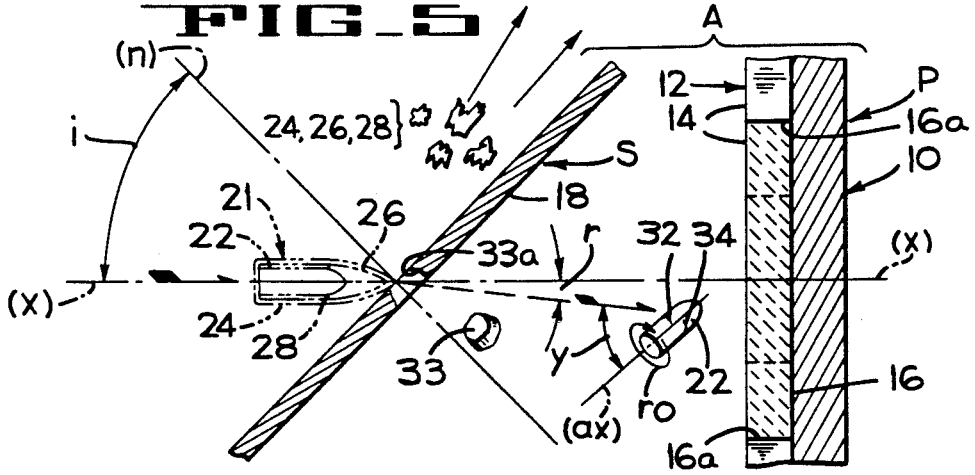
FIG_6
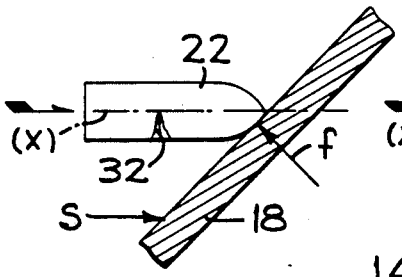
FIG_7
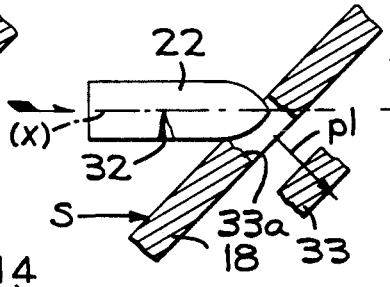
FIG_8
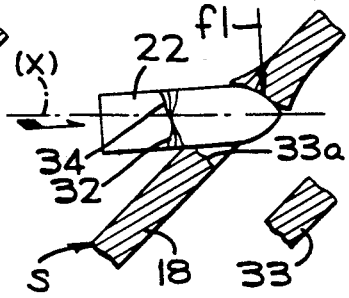
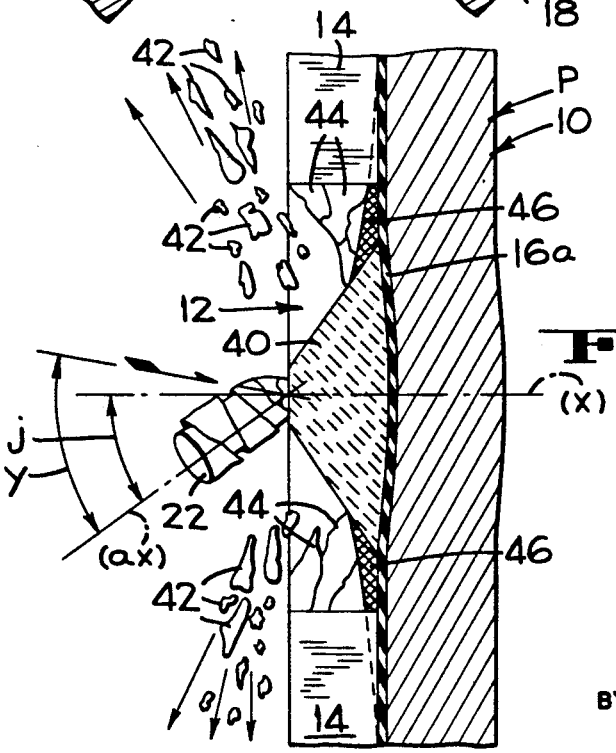
FIG_9
INVENTOR
GREGG L. MC KEE
BY Francis W. Anderson
ATTORNEY FIG_10
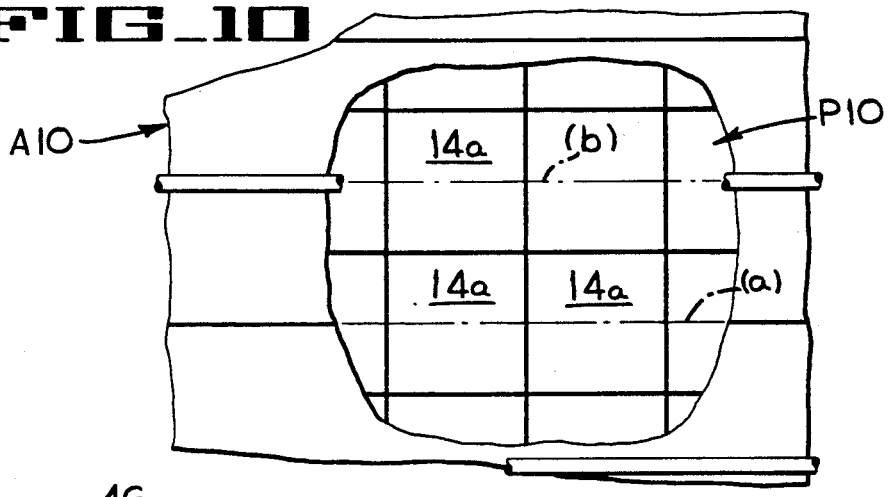
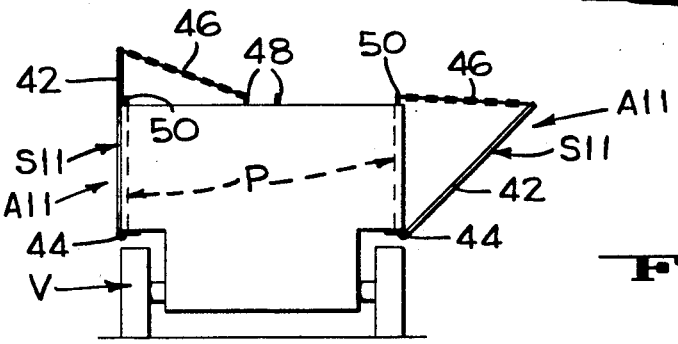
FIG_11
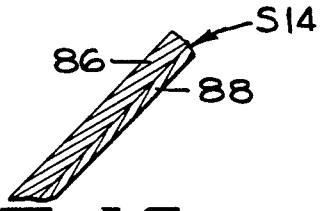
FIG_14
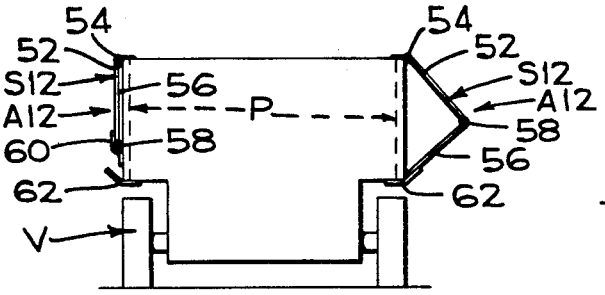
FIG_12
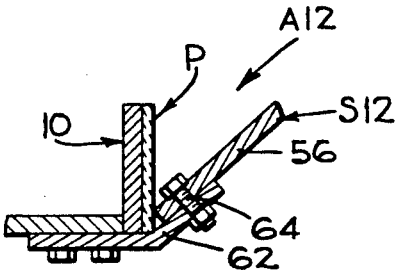
FIG_12A
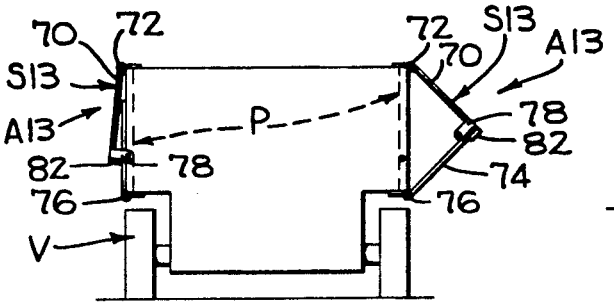
FIG_13
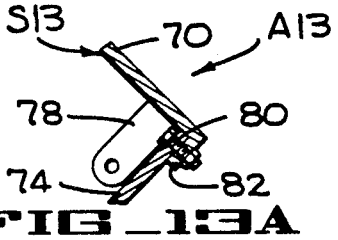
FIG_13A
INVENTOR
GREGG L. MC KEE

POLYPHASE ARMOR WITH SPOILER PLATE

This invention relates to armor designed to defeat the attack of high kinetic energy projectiles or the like. The armor to be described is particularly effective against armor piercing and incendiary bullets fired from rifles, machine guns, anti-tank guns, anti-aircraft guns or other weapons, including weapons which fire projectiles having an exceedingly hard armor piercing core, such as a core formed of tungsten carbide.

The armor of the present invention will defeat attacks of a similar nature from grenades, exploding shells, bomb fragments, etc. Considering its effectiveness, the armor requires a low total unit weight per square foot of armor. This measure of armor weight will be referred to in the description that follows as the "areal density" of the armor. When the armor is applied to a vehicle such as a tank or the like, it also serves structurally as the local wall or hull section.

The components of the armor of the present invention perform a synergistic chain of specific functions, as the effect of the attack progresses. Each component not only provides some effect of its own leading to defeat of the attack, but in so doing augments the effectiveness of the next component in the chain, in acting to further defeat the attack. The armor of this invention can be manufactured from materials and using techniques such as to render large scale production possible, it can protect as large an area as desired, and it does not require rare, intractable, hard to produce or highly critical defense materials.

The armor of the present invention is a further development of the armor forming the subject matter of the copending application of Brink et al, Ser. No. 345,269 filed Feb. 17, 1964 for Armor. The aforesaid pending application will hereinafter be referred to as "Case A".

As to the problem of defeating the attack of the higher caliber machine guns, anti-tank guns and the like, and particularly those firing armor piercing projectiles with tungsten carbide cores, the present invention represents a new approach over that described in the copending application of Brink et al Ser. No. 404,684 filed Oct. 19, 1964 for Armor. The latter application will be hereinafter referred to as "Case B". Both co-pending applications are assigned to the assignee of the present invention. The common subject matter of this invention and that of Case A and Case B is a polyphase armor component comprising an anvil and a shield of ceramic tiles.

The nature and action of the armor of the present invention can best be explained by first making brief reference to the polyphase armors of Cases A and B, referred to above.

As mentioned, the polyphase armor of Case A employs an outer layer termed a shield formed of a single layer of interfitting tiles composed of a high alumina ceramic material. These tiles have a hardness that is approximately 9 on the Moh hardness scale. This material is at least in the hardness range of the tungsten carbide cores of armor piercing projectiles, and is usually harder. The shield is backed up by an anvil, formed preferably of metal, such as an aluminum alloy, steel or the like. As described in detail in Case A, although the tile of impact may be fractured, the impact shatters the projectile core, and transforms the tile or tiles into a force distributing cone. The latter distributes the energy of the projectile or core over a large anvil area, and so prevents penetration, as well as plugging and spalling of the anvil.

The thickness of the single layer tiles, and of the supporting anvil of the armor of Case A can be increased as desired to provide a corresponding increase in effectiveness against either larger caliber projectiles, higher muzzle velocities, or harder core materials. However, firing tests have shown that a point is reached wherein the attack of these powerful weapons is more efficiently resisted by the polyphase armor of Case B.

In the armor of Case B, the shield has at least two layers of high alumina tiles covering the anvil. The armor of Case B will resist the more severe attacks of heavier weapons and harder projectiles while requiring an areal density that is less than that required to resist the same attack when employing the single tile layer polyphase armor of Case A. However, since the shield includes two layers of tiles, repair of the shield in Case B requires replacement of two layers at the damage area.

Where mobility, lightweight and practicality of construction are critical factors in the armor construction, it is not feasible to protect every combat unit with an armor which will defeat the attack of all weapons which might attack the unit, from the smallest to the largest weapon. The most that can now be demanded of any armor of given areal density, is that it will defeat an attack of a given optimum severity, and that the armor can be produced without requiring extensive use of critical demand materials, and can be built using simple, rapid, non-laboratory type fabrication methods. Such an armor is that of Case A, Case B and that of the present invention, each serving efficiently in its intended sphere of action.

The armor of the present invention can be characterized as "chain effect" armor, in that beginning with the instant of impact, the armor causes the projectile to undergo a progressive sequence of effects, each of which contributes to the ultimate defeat of the projectile. The explanation of this chain effect will be presented in connection with the attack of an armor piercing projectile having a tungsten carbide core.

The armor of the present invention includes a "spoiler" which is supported in front of and spaced from a polyphase armor like that of Case A, wherein a shield made up of a single layer of interfitting high alumina ceramic tiles, and the shield is bonded to a metal anvil. The spoiler is a relatively thin, hard tough metal member having one or more sections that are inclined at an angle (preferably in the order of 45°), to the face of the shield. The spoiler initiates the chain of effects which results in destruction of the projectile core, even though the spoiler itself is penetrated. The "pre-spoiled" or vitiated projectiles (cores), when striking one of the tiles of the shield behind the spoiler, may still be physically capable of causing the formation of a force distribution cone in the tile layer, as described in detail in Case A. However, the condition of the core after leaving the spoiler insures complete defeat of the attack by a polyphase armor component, which would be penetrated without the spoiler. This is true even if the polyphase armor itself were made thicker or heavier until its areal density alone significantly exceeded the areal density of the entire armor of the present invention.

Another important advantage of the armor of this invention is that the spoiler can be constructed to completely defeat the attacks of "lesser" projectiles, such as machine gun projectiles which do not have tungsten carbide cores. The "lesser" projectiles, which cannot penetrate the spoiler, leave the polyphase armor component intact and perfect, and hence the polyphase armor is ready to defeat subsequent major attack.

The polyphase armor component of the armor of the present invention can be repaired at the damaged area, by removing a section (or all) of the spoiler, and replacing the damaged tile or tiles in the shield.

The armor of the present invention has other features and advantages which can be best understood from the following detailed description of the best mode now contemplated for carrying out the invention. This description includes a specific example of the construction of an armor embodying the invention which will defeat a specific projectile fired from a specific type weapon.

In the drawings:

FIG. 5 is a diagrammatic section through the armor of the present invention illustrating a certain stage in the action that takes place upon impact of certain projectiles.

FIG. 6 is an enlarged fragmentary diagram showing the core of the projectile at the instant it strikes the spoiler.

FIG. 7 is a diagram illustrating conditions a split second later than those of FIG. 6.

FIG. 8 is a diagram like FIGS. 6 and 7 showing the action a split second later than that of FIG. 7.

FIG. 9 is a diagram showing the action that takes place on impact of a projectile core with the polyphase component of the armor of the present invention.

FIG. 10 is a fragmentary side elevation showing armor provided with a modified form of tile shield.

FIG. 11 is a diagrammatic end view of a vehicle, such as an amphibious vehicle, showing a modified form of spoiler as applied to the vehicle.

FIG. 12 is a view like FIG. 11 showing another form of spoiler.

FIG. 12A is a fragmentary view showing a fastening device for the spoiler in action.

FIG. 13 is a view like FIGS. 11 and 12 showing still another form of spoiler.

FIG. 13A is a fragmentary view showing how the spoiler may be readied for action.

FIG. 14 is a fragmentary section of a spoiler formed of dual hardness steel.

In the detailed description of the invention that follows, a general description of one embodiment of the invention will first be presented, followed by an explanation of the action and chain effect of the armor insofar as it is known, or can be deduced. A specific example of an armor designed to meet a certain ballistic limit or attack severity will then be given. This also includes brief descriptions of several variations in the components of the armor.

GENERAL DESCRIPTION OF THE ARMOR

Figure 1:
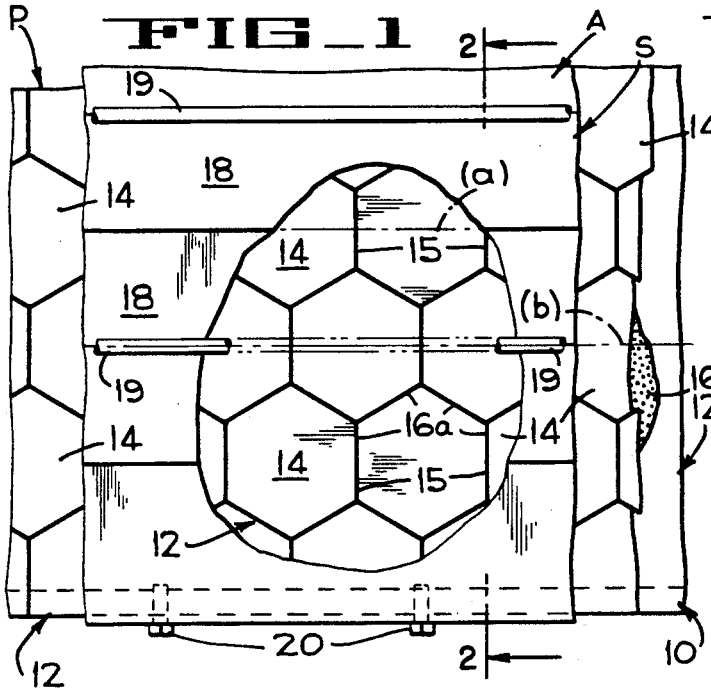
FIG. 1 is a fragmentary side elevation of an armor embodying the invention, with a portion of the spoiler broken away.
Figure 2:
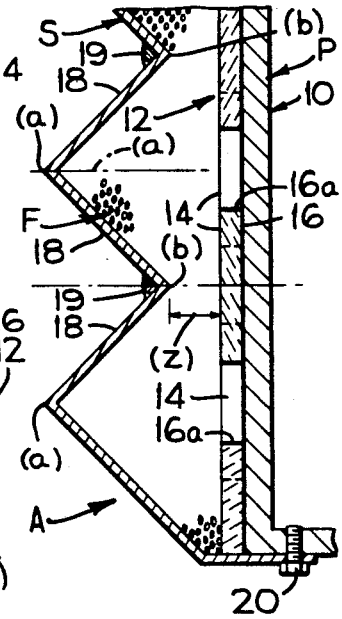
FIG. 2 is a section of the armor taken on lines 2—2 of FIG. 1.

Referring to FIGS. 1 and 2, the armor, indicated generally at A, is made up of two basic or primary components, namely, a polyphase component P, and a spoiler S. The polyphase component P can serve the structural function of the wall, hull, deck or the like, of a vehicle. The spoiler S is mounted on the outside so as to overlie the polyphase component P, with the spoiler at all points (except those necessary for support) being spaced a substantial distance from the polyphase component of the armor.

The polyphase component P, in the example given, is like that described in detail in Case A, hence reference to Case A is made for detailed examples of materials, fabrication and design considerations that are common to both armors. The polyphase armor of Case A, as well as that of Case B also previously referred to, is described as preferably having a cover sheet of fiberglass or the like on its exterior. This cover sheet is not as important in the armor of the present invention as it was in the aforesaid applications, and hence is not shown. However, it may be added if desired, without affecting the mode of operation of the armor of the present invention.

Briefly, the polyphase armor component P comprises an anvil 10, preferably formed of a relatively strong, ductile metal. The anvil serves as a support and backing for a tile shield 12 formed of an interfitting mosaic of sintered high alumina ceramic tiles 14, preferably having an assay of at least 94% alumina. The critical criterion; however, is the hardness of the tiles, which should have a hardness number of approximately 9 on the Moh scale. The tiles 14 are bonded to the anvil 10 by means of an adhesive layer 16. Some of the adhesive 16 is also caused to extend between adjacent edges of the tiles 14, as indicated at 16*a*. Considerations relative to the selection of the tiles and the adhesive 16, are explained in detail in Case A.

The spoiler S must satisfy three geometrical and physical requirements, under the present invention. One of these requirements is that of much as the spoiler as is possible should be inclined relative to face of the shield. Another is that the spoiler (at substantially all points) must be spaced a substantial distance from the face of the shield 12. The third is that the spoiler be formed of a material that is sufficiently tough and of sufficient thickness to "spoil", vitiate, fracture and otherwise degrade the projectile core, be it a tungsten carbide core or a core of similar hardness. Thus the spoiler sets up conditions resulting in complete defeat of the attack by the polyphase component P.

In the example shown in FIGS. 1 and 2, the spoiler S is formed of a plurality of connected panels 18 forming a zigzag. The armor portion shown in FIGS. 1 and 2 will be assumed to be vertical, to provide descriptive orientation. The tiles 14 forming the shield 12 are bonded to the anvil 10 so sets of flats 15 are arranged vertically. With this disposition of the tiles, the spoiler S is arranged so that the peaks of the spoiler panels 18, which lie along lines (a), run horizontally, as do the valleys, which lie along lines (b). The relative dimensions of the hexagonal tiles 14 in the plane of the armor, and the spacings between the peaks and the valleys of the spoiler zigzags are such that the lines (a) and (b) of the spoiler, namely, their peaks and valleys, overlie the geometrical centers of the underlying tiles 14.

This angular relation between the peaks and valleys of the spoilers and the flats of the tiles is selected to minimize the statistical probability of a projectile that penetrates the spoiler, along the valleys (b) of the spoiler from striking the shield at tile edges. The peaks and valleys at (a) and (b) define planes that are parallel to the shield 12, particularly the outer faces of the tiles. The spoiler S, as a whole, will be characterized as parallel to the shield, although, its panels 18 are inclined to the tile faces as described.

In the zigzag form of spoiler S shown in FIGS. 1 and 2, the valleys along lines (b) are provided with deflector bars 19 which are tack welded to the spoiler. These bars reinforce the spoiler at the valleys (b), and are particularly effective against projectiles that strike the spoiler at zero obliquity, and directly along one of the valleys. The bars 19 are formed of round steel rods, so that they are structural members which present a convex surface to the attack.

In order to minimize the areal density of the armor of the present invention, it is designed so that attacks of maximum severity which are to be defeated, will penetrate the spoiler. Reliance for final defeat of these attacks is placed on the polyphase armor component P. In cases where the armor is applied to mobile units, such as vehicles or the like, it is often important that the spoiler be removable for replacement of tiles 14 that are damaged. Thus the spoiler S can be made in the form of a detachable metal sheet, secured to the anvil (the hull of the vehicle as seen in FIG. 2) by means of fasteners 20 along the edges of the armored area.

If the protected section has a very large area, it may be found expedient to fabricate the spoiler S in the form of sections or modules, which are connected to the protected polyphase armor underneath and to each other by any suitable fastening expedients, the details of which are not critical to the present invention and hence are not illustrated.

The voids between the spoiler S and the polyphase component P is shown filled with a light cellular material such as a polyurethane foam F. If this is a closed cell material, it not only serves to initially hold the spoiler clear of the shield but also adds bouyancy to any amphibious vehicle or the like on which the armor is incorporated.

OPERATION OF THE ARMOR

The action of the armor of the present invention in defeating the attack of a projectile having an armor piercing core, such as a core formed of tungsten carbide, is illustrated diagrammatically in FIGS. 5–9 and there follows a brief explanation of these diagrams. It will be understood that since events to be described take place in a millisecond (approximately), and since the zone of impact at firing tests is a danger area, the explanations to follow are based on examinations of the various parts and fragments after the firing, coupled with knowledge of the physical factors involved, such as the velocity of the projectile (which can be measured) the nature of the core, the angle of impact, the range, and the construction of the armor.

Referring to FIG. 5, an armor A embodying the invention is illustrated diagrammatically, and the section is taken through an armor similar to that of the section of FIG. 2, but on a larger scale. The projectile 21, the construction of which is given by way of example, is shown in phantom at the instant of impact with the spoiler S. The projectile shown includes an armor piercing core 22, a jacket 24 (which is usually made of steel in armor piercing projectiles), a nose filler 26 in the ogive, which may include a thermit charge, and a small bed 28 of lead surrounding the hardened core 22. The trajectory of the projectile in this, and in succeeding diagrams, is illustrated by an arrow having a head and tail on one side thereof.

In FIG. 5, line (x) is drawn, which is normal to the component P and passes through the center of one of the tiles 14. The panel 18 of the spoiler S has its normal line (n) inclined from the line (x) by an angle "i" of 45°. The trajectory of the projectile coincides with the line (x), as indicated by the special arrow in FIG. 5, except for the effects of gyroscopic precession (not shown).

Upon impact of the projectile 21 with the spoiler panel or plate section 18, the material of the plate 18 is strong enough, and its thickness is such as to cause the jacket 24, any fragments of the nose filler 26 that are not ignited, and the lead bed 28 (if present) to fragment and shatter. Due to the inclination of the spoiler plate, these particles ricochet off as illustrated by the jagged particles in FIG. 5, leaving for further attack the stripped armor piercing core 22.

After the projectile core is stripped clear, it strikes the plate 18 of the spoiler S, and the moment of impact is illustrated in FIG. 6, which is drawn at twice the scale of FIG. 5. Since the plate 18 of the spoiler is inclined from the axis of the projectile at the point of impact, a high shock load indicated by a force arrow f, is applied to the nose of the core 22. This loading, resisted by the instantaneous moment of inertia of the core, provides a high eccentric or beam loading on the core. Since the spoiler plate 18 is of a tough material, such as an alloy of steel, the off-axis impact loading of the projectile core loads the core as a beam, and initiates vibration in the core. This probably causes one or more cracks, indicated at 32 in FIG. 6, to be generated and propagated across the core. This cracking and vibration inducing effect increases as projectile velocity increases. Also, the stress which "pre-spoils" the projectile is largely independent of the thickness of the spoiler, but depends principally on the densities of the projectile core and the spoiler, the inclination "i" of the spoiler, and the velocity of the projectile.

Referring to FIG. 7, upon impact of the projectile core with the spoiler plate 18, a plug 33 of the spoiler material is driven clear of the spoiler, on a path (p1) generally normal to plate 18, leaving a hole **33*a*** in the plate, the axis of the hole also being generally normal to the plate.

Referring to FIG. 8, as the projectile core 22 proceeds through the hole **33*a* left by a plug 33, a portion of the nose of the core opposite to that which received the shock loading upon initial impact as seen in FIG. 6, will be shock loaded by another force of great magnitude indicated by a force arrow f1 in FIG. 8. This reversed loading of the projectile core, coupled with vibrations previously set up in the core, augment the cracking and preliminary weakening of the core. Thus the core is "spoiled" before it completely penetrates the spoiler plate 18, and before it strikes the polyphase armor component P lying behind the spoiler. These secondary fractures induced in the projectile core 22, on partial penetration of the spoiler, are indicated at 34 in FIG. 8**.

After the core penetrates the spoiler, the conditions before impact with the polyphase component P of the armor of the present invention are shown diagrammatically in FIG. 5. As any projectile penetrates an inclined sheet of armor of significant thickness, assuming that the projectile axis is generally parallel with its trajectory, the projectile is refracted by the plate through a small angle indicated at "r" in FIG. 5.

Another effect of the inclined sheet of armor on the projectile core, which is believed to be of more importance than the aforesaid refraction of the trajectory, is an angle of tumble or yaw indicated at "y" in FIG. 5. This is an angle between the axis (x) of the core and the new trajectory of the core indicated by the special arrow.

The angle of yaw "y", which can be relatively large angle, may be largely caused by gyroscopic effects. Since a core fired from a rifled barrel is rapidly rotating, as indicated by the arrow "ro" in FIG. 5, the impact torque applied to the projectile core by the spoiler provides a powerful precessing force to the spinning core and hence causes it to precess in a direction wherein its axis (ax) is not aligned with its trajectory. The projectile core traveling rapidly, with a relatively large angle of inclination between its axis (x) and the plane of the outer faces of the tiles, 14 and bearing cracks 32, 34 is now in condition for complete shattering and defeat by the polyphase component P. This defeat action is illustrated diagrammatically in FIG. 9. Here the previously weakened and vibrating projectile core 22 is shown just after the moment of impact with one of the tiles 14. A force distributing cone or pedilate 40 is formed in the shield 12. The cone 40 distributes the force resulting from conversion of the kinetic energy of the core over an area of the anvil 10 that is sufficiently large to prevent plugging of the anvil, spalling of the anvil and excessive bulge of the anvil, all as explained in detail in Case A. Fragments 42 of the tile of impact are disrupted and fly clear of the impact zone. Other fragments 44 of the tile impact may remain in place, and as explained in Case A, a radially cracked zone 46 may surround the force distributing cone 40.

The projectile core 22 having heen previously weakened by successive blows and having struck the tile of impact with its axis (ax) inclined from the normal line (x) by a relatively large impact angle "j", is shattered. The impact angle "j" provides a third off-center or beam loading on the core, which further contributes to destruction of the core, at least insofar as penetration capabilities are concerned. The fragments of the core after, ricocheting off the tiles are trapped by the spoiler, and by the foam F (if present) and hence cannot injure personnel support disposed in the vicinity of a vehicle bearing the armor of the invention.

Since the spoiler S is inclined to the face of the polyphase component P, attacks of lesser severity are defeated by the spoiler, itself. Thus, projectiles of smaller caliber, or larger projectiles having hardened steel cores or other cores softer than tungsten carbide or the like, will recochet from the face of the spoiler without penetration and without plugging the spoiler. This leaves the layer of tiles 14 within the spoiler in their original, uncracked condition, ready for defeating and shattering a subsequent attack by a tungsten carbide core, up to the design limit of the armor.

Due to the relative inclination of the spoiler plates 18 and the polyphase armor component, and as can be understood from inspection of FIG. 2, projectiles striking the plates 18 of the spoiler between the peak lines (a) and the valley lines (b) are defeated by the armor in the manner described and illustrated in connection with FIGS. 5-9. Projectiles striking the peak lines (a) exactly, will be deflected so as to have their axes (ax) inclined from the trajectory as shown in FIG. 5.

Projectiles striking the valley lines (b) are intercepted by the round reinforcing bars 19 tackwelded along the valleys at spaced intervals. Since these bars present a convex surface to the projectile, the projectile and its core are deflected and strike the adjacent plate of the spoiler. Thus the direction of the projectile is changed, its energy is diminished, and its penetrating effect is reduced, so that even if it penetrates the spoiler (which is unlikely), it would probably not even strike the polyphase component P behind the spoiler.

In FIG. 5, the trajectory of the projectile is shown inclined by an angle of incidence "i" to the spoiler. This angle of incidence of the trajectory to the normal (n) of the spoiler represents a statistically close approximation of the trajectory of projectiles fired from ground-to-ground attacks at relatively close range, where the trajectory is flat. Thus, the spoiler introduces the yaw angle (y) illustrated in FIG. 5 in most combat conditions. If the projectile comes in at an angle, say along the normal line (n) of FIG. 5, even though they penetrate the spoiler plate, since they come along the normal angle, they will not be deflected and perhaps the yaw forces applied thereto are small, so that these projectiles might continue substantially along their original impact trajectories. In this case, if the projectile core strikes the polyphase armor underneath, it does so at an angle of obliquity, and its destructive effect is dimenished. These projectiles will either be shattered, or will recochet from the polyphase armor rather than to penetrate it.

Projectiles that strike the spoiler at some angle in between the lines (x) and (n) of FIG. 5 partake of both effects. They are eccentrically loaded upon impact with the spoiler and hence are usually cracked before penetration. Also, such projectiles will yaw (angle "y") as shown in FIG. 5. Finally, regardless of the deviation due to penetration of the spoiler, the initial trajectory of such projectiles has an angle of incidence with the polyphase armor component tiles that is not 90°, and hence represents an attack that is readily easily defeated by the polyphase armor component.

SPECIFIC EXAMPLE OF AN ARMOR

By way of example of the best mode contemplated for carrying out the invention for a specific attack, a more detailed description of the armor of the present invention will now be described. This armor has been found by firing tests to successfully defeat the attack of a 14.5 mm. anti-tank rifle, having a nominal muzzle velocity of 3280 ft/sec. The tests upon which the information that follows is based, were performed to exceed even the most severe battle conditions to be expected from an attack against the side wall of a tank, amphibious vehicle or the like, by the weapon referred. The gun was mounted in a special vise, which receives the barrel and breach mechanism and which provides for precise bore sighting of the gun. The armor samples were made up as replicas of the armor designed for the attack of the particular gun, and had an area sufficiently large so that all effects of the attack were confined within the bounds of the test section of the armor.

The projectiles had armor piercing cores of tungsten carbide material, having a hardness of about 9 on the Moh scale, and weighting 38 grams. The armor test section was backed up in a manner which was as firm or firmer than the backing supplied by the hull of a vehicle such as those described. The armor section was placed in an apertured box for providing a safety shield, which also trapped all fragments of the various elements disrupted by the impact. The velocity of the projectile during its trajectory between the gun and the test armor was measured by conventional means. The gun was fired at point blank range, with the trajectory following the line (x) of FIG. 5, normal to the face of the armor shield 12. The inclination angle "i" of the spoiler plate 18 from the normal line (x) was 45°. The spoiler was formed of plate steel ¼" thick formed of a grade steel designated as "XAR-30 Steel", supplied by the Great Lakes Steel Company at Ecourse, Mich., and hardened to 500 BHN.

The tiles 14 are formed of a sintered high alumina ceramic sold as "Wearox-A". This material has an alumina content of 99.5% and is manufactured by the Western Gold and Platinum Company of Belmont, Calif. The considerations relative to tile composition and selection when designing armor for a given attack are explained in detail in Case A, and apply to armor of the present invention, except that due to the spoiler, more severe attacks are resisted by the armor of the present invention by a tile shield of a given thickness and quality.

the tiles are hexagonal and measure four inches across the flats, and are ⅝ of an inch thick. The hexagonal shape provides interlocked rows, so that there is no tile shifting on impact. The use of discrete tiles keeps the impact damage from spreading, facilitates procurement, and expedites repair.

The adhesive 16 is a polyurethane based adhesive, but it may be one of the adhesives described in detail in Case A.

The anvil 10 is formed of armor quality aluminum alloy designated in the aluminum industry as 7039, armor grade. It is three-quarters of an inch thick. The areal density of the complete armor of this example is only 39.1 pounds per square foot. Alloy 5083 could also be used.

As mentioned, projectiles of 14.5 millimeter caliber having tungsten carbide cores were completely defeated without plugging, spalling, or excess bulge of the anvil. In fact the anvil bulge averaged only a fraction of an inch over a number of test firings. The attack of lesser projectiles, such as 30 caliber machine gun bullets, was also readily defeated. These projectiles ricochet off the spoiler, without penetration thereof and without causing plugging of the spoiler. The tiles within the spoiler are undamaged by such attacks. It was found that the minimum thickness of the spoiler, given as one-quarter inch in the example above, is often not determined by its ability to spoil the carbide core of the 14.5 mm projectile described, but by its ability to completely defeat and deflect the attack of lesser projectiles, such as 30 caliber machine bullets, thus preserving the shield of the polyphase component impact. Firing tests of the type previously described indicate that a spoiler having a thickness of as little as 0.170 inches, instead of one-quarter of an inch, will spoil the tungsten carbide cores of 14.5 millimeter test projectiles so that they are readily defeated by the polyphase component of the armor.

The example of materials given above in connection with armor designed to defeat a 14.5 mm projectile having a tungsten carbide core, represents what appear at present to provide one of the best modes of practicing the invention. However, there is no single "best" mode because of the variables such as ease of procurement, fabrication, etc. which also enter into the selection of the various materials employed. Other materials can be employed without significantly changing the areal density of the armor, and some are mentioned below. In selecting the tiles, it has been found that the effectiveness of the present armor less sensitive to variations in tile quality, than are those of Cases A and B, and this is another unexpected but practically important advantage of the armor. The armor of the present invention has been found to be relatively more effective when the core of the projectile which penetrates the spoiler strikes the shield along a division line or edge of the tiles 14.

OTHER MATERIALS

In addition to the materials given above by way of example, the various components of the armor of the present invention can be formed of other materials, found to produce substantially the same protection. For example, the protection against lesser attacks, such as 30 caliber machine guns, provided by the spoiler, can be increased over that given in the above example if a special laminated steel plate is employed. This material is referred to in the iron and steel industry as "Dual Hardness Steel". It is formed by hot rolling and bonding steel sheets of different composition and hardness to one another, to form a composite sheet of the desired thickness.

Other materials suitable for the spoiler are an alloy steel plate supplied by the Republic Steel Company, of Cleveland, Ohio, known as the "9-4-25 Alloy Steel" hardened to a BHN number of 522–530. The "Hadfield" steel used for aircraft armor, conventional faced hardened steel armor, and high quality nickel alloy homogeneous steel armor can also be used as the spoiler.

As an alternative to the use of "Wearox-A" high alumina ceramic for the tiles of the shield these tiles may be made of "AL 995" (99.5% pure high alumina ceramic) or AL 300 (a 97.6% pure high alumina ceramic). Both are supplied by the Western Gold and Platinum Company previously mentioned.

The tiles can also be moulded from AD 94, a 90% pure high alumina ceramic as well as from AD 85, a 85% pure high alumina ceramic. These are manufactured by the Coors Porcelain Company, of Denver, Colo.

As an alternative to the Narmco polyurethane based adhesive mentioned above, another polyurethane based adhesive sold to the trade as "APC 1252 with catalyst 1252C" may be employed. This adhesive is manufactured by the Applied Plastics Company Inc., of El Segundo, Calif.

As to the anvil, instead of the more common aluminum armor grade alloy 7039, an aluminum armor grade alloy 7075 may be employed. Also various other anvil materials referred to in Case A, when selected in accordance with attack, weight, fabrication, and other requirements special to each application of the invention, can be employed.

If a buoyant filler F is to be employed it will preferably be a closed cell flame resistant material, such as a polyurethane foam or a polystyrene foam having a density of 2.0 to 2.5 pounds per cubic foot. Neutron shielding may be incorporated in the filler by including boron compounds in the foam. A closed cell polyvinyl cloride polyethylene or polypropylene sheet, or other closed cell sheet can also be used.

As to the angle of obliquity or the inclination angle "i", FIG. 5, between the spoiler and the normal line (x) of the polyphase armor component P, the angle of 45° represents the preferred angle, taking into consideration all of the various factors normally involved wherein the attacker and the target are generally at the same level, or the line between them represents the line (x) in FIG. 5. In some applications, the entire armor, that is the polyphase component P and the spoiler component S can be inclined together, for presentation to any selected trajectory such as a lobbing projectory, or the relatively steep trajectory presented by long range rockets or guns. As mentioned, projectiles within the design range of the armor, and which approach the armor along the normal line (x), FIG. 5, represent the most severe attack, but these are caused to yaw and are readily defeated by the armor. Projectiles with approach trajectories which are oblique to the polyphase component, have inherently less destructive power than do zero obliquity trajectory projectiles. The former are also defeated by the armor of the present invention, even though their angle of incidence to the spoiler itself is reduced as the obliquity of their attack is increased.

As a general rule, optimum utilization of the materials results from an incidence angle "i" between the normal of the spoiler and the normal of the polyphase component (which is also the inclination of the spoiler plates to the shield) of 38° to 45°. If the angle of incidence is substantially less than 38°, the spoiler is too "flat" to the trajectory, and the advantages of the oblique or eccentric loading of the core by the spoiler are reduced. There is usually no advantage in providing angles of incidence "i" that are much greater than 45°, because this merely results in an increase in the overall depth (thickness) of the armor as measured along the normal line (x) of FIG. 5, without materially increasing its effectiveness. It should also be recognized that in designing armor for carrying out the present invention, an incidence angle "i" of 45° not only provides a good, all around performance but will often be found to minimize the areal density of the armor. As the angle of incidence "i" increases over 45°, the weight of spoiler required increases progressively and rapidly, so that the spoiler adds more in the way of areal density than is made up in its projectile deflection properties.

MODIFIED EMBODIMENTS

Figure 3:
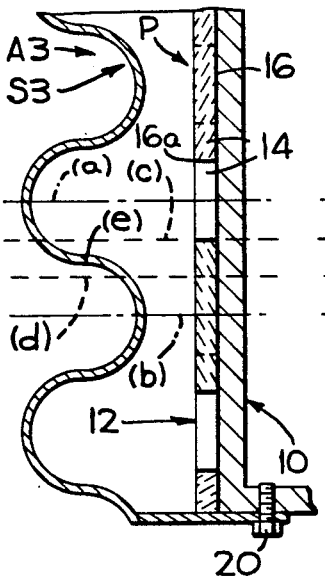
FIG. 3 is a section like that of FIG. 2 showing an armor employing a modified spoiler, with a diagram at the right indicating the dispostion.
Figure 3A:
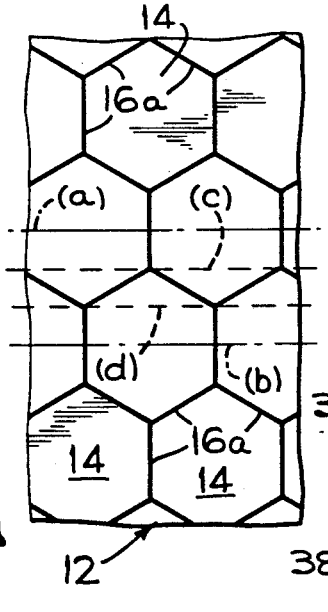
FIG. 3A shows the tile line up of FIG. 3.

FIGS. 3 and 3A show a modified form of armor A3, wherein the polyphase component P is like that previously described but the spoiler S3 is formed of sinuously corrugated sheet metal. These spoiler plates are readily shaped by rolling. In this form of the invention the convex peaks of the spoiler S3 will ordinarily deflect a projectile striking them, unless the trajectory is precisely aligned with the peak line (a) and, normal to the shield 12. The probabilities of such occurrences are statistically of little significance. The valleys of the spoiler S3 lie along the line (b) that passes through the center lines of a lateral row of tiles. Since the valleys are the most vulnerable portion of this armor, they are disposed so that the rare projectile having a trajectory coincident with the line (b) will be directed after penetration of the spoiler towards the tiles in a plane passing through the centers of a lateral row of tiles.

In the form of FIG. 3, and as clearly seen by referring to FIG. 3A, the lines (c) and (d) which pass laterally through the tile corners, are equi distant from a plane passing through (e) on the spoiler S3, at the junctions of the peak and valley sections of the spoiler. The zones of the spoiler between the lines (c) and (d) of FIG. 3, are the least vulnerable zones of the spoiler, and cause the most projectile deflection and highest beam loading. Hence this zone is positioned as shown in FIGS. 3 and 3A, in order that the portions of the armor having the most tile edges and corners lie behind the portions of the spoiler which are most apt to deflect or even defeat all the projectiles attacking them.

Figure 4:
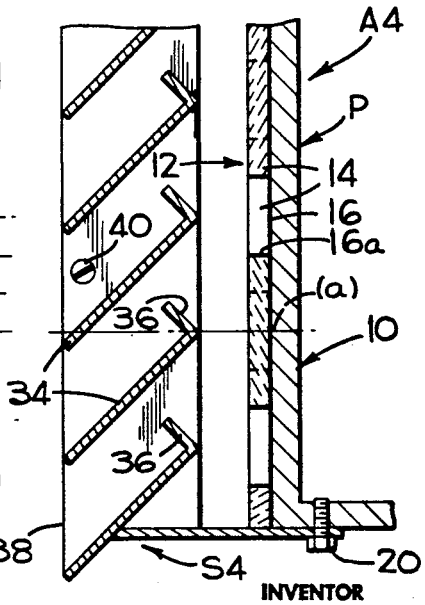
FIG. 4 is a section like FIGS. 2 and 3 showing another modified form of the invention.

FIG. 4 shows a modified form of armor A4, wherein the polyphase component P is like that previously described. The spoiler component S4 is in the form of a horizontally running metal plate 34 arranged in the manner of Venetian blinds, and having re-entrant flanges 36 for trapping ricocheting particles or projectiles. The flanges 36 also close the gaps to all normal trajectories originating below the armor. The plates 34 are inclined at an angle of approximately 45° to the face of the shield 12, as in the form of FIGS. 1 and 2. The spoiler S4 of FIG. 4 may also be applied in the form of modules by welding the ends of the plates 34 to vertical side strips 38, and the latter are fastened together by means of fasteners such as screws 40. The intersection of the plates 34 and the flange 36 present the valleys in the spoiler which plates are lined up with the horizontal (a) centerlines of the tiles, as in the embodiments of FIGS. 1-3.

FIG. 10 shows a modified form of armor A10, wherein the modification is in a polyphase component designated P10. Here the tiles 14*a* are four inch squares, instead of being hexagonal. This construction is not as efficient as that of FIG. 1, wherein the tiles are hexagonal, because hexagonal provide interlocking so as to eliminate the planar displacement entire rows of tiles upon impact. Also, the number of aligned adjacent tile edges is greater than in the case of hexagonal tiles, where the edges do not form continuations of one another. The compositions and dimensions of the armor of FIG. 10 are those of FIGS. 1 and 2 with the peaks (a) and the valleys (b) of the spoiler passing through the centers of the square tiles 14*a*.

SPECIAL VEHICLE APPLICATIONS

In cases where the armor of the present invention is to be employed on combat vehicles such as tanks, amphibious vehicles, or the like, the spoiler can take a different form, although its action will remain the same as that of the embodiments previously described. One of these installations is shown in FIG. 11, which is a simplified diagram showing combat vehicle V. viewed end on. Here the polyphase component P of the armor A11 forms a side wall or hull portion of the vehicle. The polyphase component P is constructed in accordance with the previously described embodiments of the invention. A single spoiler S11 for each polyphase component is in the form of a plate 42, hingedly mounted at 44 on the hull, along its lower edge.

When not in action, the spoiler plate 42 is secured in its retracted position, as shown at the left of FIG. 11, by means of a chain 46 and connected to the upper edge of the spoiler plate 42 and to a fastener 48 on the upper deck of the vehicle. When readied for action, as seen at the right of FIG. 11, the chain 46 is unhooked from its fastener 48, and connected to a ready fastener 50 at the side of the vehicle. The chain and fastener combination, the details of which are not critical to the invention, can readily be selected to provide the desired angle of inclination of the spoiler S1. By making the spoiler plate 42 retractable, the width of the vehicle is minimized when the vehicle is not in action. If desired, several, narrower hinged spoiler plates like plate S11 can be hingedly mounted to the side of the vehicle, and operated in the manner of spoiler S11.

FIG. 12 shows in simplified diagrammatic form another type of spoiler for mounting on combat vehicles. Here the armor A12 also employes a polyphase component P as a portion of the vehicle wall or hull, as in FIG. 11. However, the spoiler S12 is made of two plates. An upper plate 52 is hinged to an upper portion of the vehicle at 54. A lower plate 56 is hinged at 58 to the lower edge of the upper plate 52. When the armor is secured, the plates 52, 56 are folded together and retained against the polyphase component P by detachable clips 60, in the form of a z-shaped bracket detachably secured to the hull below the hinge 58.

When the vehicle of FIG. 12 is readied for action, the spoiler plates are freed by removing the clips 60 and the spoiler plate sections are folded out as seen at the right of FIG. 12. The lower end of the lower spoiler plate 56 is secured to a bracket 62 carried by the lower edge of the armored wall, as seen in FIG. 12A, by fasteners 64. The details of the securing and readying the spoiler plates for action are mechanical features which are not critical to the present invention. The embodiment of FIG. 12 has the advantage over that of FIG. 11 in that the lateral extent of the readied armor is substantially less than the lateral extent of the readied armor of FIG. 11.

FIG. 13 illustrates still another form of a retractable spoiler plate and polyphase armor component of an armor by the invention. Here the armor A13 is applied to the vehicle with the polyphase components P being provided and arranged as before. The spoiler S13 is formed of an upper plate 70 hinged at 72 along its upper edge to the top deck of the vehicle. A lower spoiler plate 74 is hinged at 76 along its lower edge to a lower portion of the protected vehicle wall or hull. The spoiler plates 70, 74 are secured by clips 78 attached to the ends of the upper plate and bolted to the end walls of the vehicle. These details are not critical to the present invention. When the vehicle of FIG. 13 is readied for action, the spoiler plates 70, 74 are folded out and their free ends are connected by fasteners 80, FIG. 13A. The fasteners 80 pass through a flange 82 bent over from the free edge of the upper spoiler plate 70 into the lower plate 74.

It is to be understood that in the forms of the invention of FIGS. 11–13, as in the previous forms, the inertia of the spoiler is adequate to impart the desired eccentric or beam loading forces to the projectile core for insuring destruction of the core by the polyphase armor component, if the core penetrates the spoiler. Thus the fasteners and other structure which holds the spoiler plates in their ready positions in the embodiments of the invention of FIGS. 11–13 need only withstand normal jarring of the vehicle.

In practice of the invention, and in all embodiments described above, the components of the armor of the present invention cooperate in a synergistic manner. Assuming a given caliber weapon firing projectile having tungsten carbide or similarly hard armor piercing cores, the effectiveness of the entire armor of the present invention is greater than that which would be expected from considering its areal density. Thus an armor of low areal density is made possible by the present invention which is capable of stopping relatively severe attacks, attacks which cannot be stopped by prior or conventional armors, even those having a higher areal density.

As mentioned, the contribution of the spoiler is enhanced by the use of composite spoiler plates formed of "Dual Hardness" steel. A fragmentary section of such a steel is shown in FIG. 14. Dual Hardness steel is usually formed of two sheets of steel initially hot rolled together from slabs or bars produced individually in early stages of the hot rolling process. This provides a hot weld bond between the differently constituted layers. This composite structure is then rolled to produce sheets of the desired thickness. For example, as seen in FIG. 14, part of a spoiler S14 is shown in section. Assuming the sheet 86 to be the outer sheet, this sheet will be a tough, alloy steel which provides excellent penetration resistance qualities to the steel armor. After cold rolling, sheet 86 has a hardness of 67 on the Rockwell scale C. The inner sheet 88 may be of a milder steel which stiffens the plate, and backs up the outer sheet 86 for maintaining its penetration resistent qualities of the armor. The inner plate may be ordinary carbon steel having Rockwell hardness of 50 on scale D, after cold rolling. This steel is supplied (for example) by the Republic Steel Company of Cleveland, Ohio, as their "50/50 Armor Steel".

Having completed a detailed description of several embodiments of the invention, one of the important features of the invention is the prestressing, fracturing or "spoiling" of tungsten carbide cores, or the like, by an inclined spoiler, coupled with the introduction of a yaw angle to the core as it penetrates the spoiler. (No attempt is made to defeat these cores, to do so would require an unacceptably high areal density). The thickness of the spoiler, its inclination to the polyphase component P (as measured by the inclination angle "i" in FIG. 5) and the material of the spoiler, all enter into the armor design for an attack of maximum severity. As mentioned, the spoiler thickness is also a factor in defeating the attacks of lesser severity without spoiler penetration. Thus in view of the geometry and physical factors involved, it is not feasible to use a generalized formula for designing all components of the armor of the present invention. Yet this can be done by a few test firings, guided by the principles set forth.

In order that the projectile or its core be permitted to develop a substantial yaw angle "y" as shown in FIG. 5, the spoiler must be spaced from the polyphase component P by some distance, which is preferably at least equal to or greater than the maximum dimension of the projectile of its core. This determines, for example, the distance (z) between the valleys of the armor of FIGS. 1 and 2 and the outer face of the shield 12.

The anvil must be strong and rigid enough to back up each tile of impact, so that tiles cannot plug through the anvil. Furthermore, the anvil material should not spall at the zone of impact, nor should it bulge excessively. In the appended claims the term "anvil", when unqualified, refers to an anvil having these characteristics.

Reference in the claims to the base metal for the anvil as being "iron" includes iron-carbon alloys usually classified as steels. There is a large collective class of steels which would be suitable for use as an anvil in the present invention, and there is nothing inherently critical as to their carbon content. The term "iron" also is intended to encompass the use of alloy steels, such as steels containing manganese, nickel, chromium, molybdenum, vanadium, etc. which are alloyed to produce a high degree of tensile strength, toughness, and ductility. The same factors apply to the spoiler.

Reference in the claims to the base metal for the anvil as being "aluminum" is intended to include alloys of aluminum, such as those which include small percentages of copper, manganese, silicon, etc., for improvement of strength. These alloys are preferably heat treated to increase their tensile strength by a solution or heat-treatment followed by a natural aging, or by an artificial aging (precipitation heat-treatment) process.

Reference in the claims to the base metal of the anvil as being "titanium" is also intended to include titanium alloys such as those having small percentages of manganese, iron, aluminum, calcium, molybdenum, vanadium, etc., to improve strength and ductility.

A base metal of magnesium alloyed with lithium, designated by the Magnesium Manufacturer's Association, 1907 Book Bldg., Detroit, Mich., as Alloy No. LA141, could be employed. This alloy contains 85% Mg, 14% Li, and 1% Al.

Another effective alloy that can be used to form the anvil, is a beryllium base alloy containing copper, particularly if it is annealed, cold worked, and aged.

As mentioned, tiles 14 are sintered alumina tiles having a high alumina content. These tiles are referred to by the Alumina Ceramic Manufacturers Association, of New York City, as "High Alumina Ceramics". The Association employs the term "High Alumina Ceramics" to describe high quality, fine textured, impervious alumina ceramics having an alumina content of 80% or more. The balance of the tile content includes fluxors or glass formers such as alkaline earth oxides, metalic oxides, or both. For the purpose of the present invention, tiles having an alumina content of 94–99.9% purity are preferred, although as mentioned before, in the armor of this invention, tile quality is not as critical as in the armors of Cases A and B.

In the appended claims, when the tile material is referred to by the term "sintered high alumina ceramic", without defining the alumina content, the term referes to the composition of "High Alumina Ceramics", as defined by the Alumina Ceramic Association, previously mentioned.

If comparative test firing show that a shield formed of tiles in the lower range of alumina content does not stop the projectile, a tile material having a higher alumina content is selected, or in some cases, a denser tile material having the same alumina content may defeat the attack. The percentages of alumina in the tiles are by weight, in all of the examples.

Although the sintered alumina tiles are preferred because of their availability and relative ease of fabrication, from the standpoint of performance alone, tiles of sintered boron carbide could also be employed.

The armor of the present invention not only performs well against the attacks of tungsten carbide core projectiles as explained, but has the additional advantage that it is an "all purpose" armor against kinetic energy projectiles. It is effective against soft ball ammunition; hard steel cores; monoblock, full caliber armor piercing projectiles (decrementally decreasing in hardness from nose to tail); and armor piercing-capped projectiles. The ability of this armor to defeat exceedingly hard projectiles (e.g. tungsten carbide cores), as well as the relatively higher mass, but not so hard projectiles mentioned above, has been explained in detail.

Having completed a detailed description of the invention so that those skilled in the art may practice the same, I claim:

1. Composite armor comprising a polyphase component having an anvil and a shield backed up by the anvil, said shield comprising a mosaic of interfitting sintered high alumina ceramic tiles having a hardness number of approximately 9 on the Moh scale; and a spoiler component comprising corrugated metal plate means in front of and spaced from said shield, said spoiler plate means being generally parallel to said shield; said tiles being hexagonal, the peaks and valleys of the corrugations of said spoiler plate means coinciding with the centerlines of parallel rows of tiles.

2. Composite armor comprising a polyphase component having an anvil and a shield backed up by the anvil, said shield comprising a mosaic of interfitting sintered high alumina ceramic tiles having a hardness number of approximately 9 on the Moh scale; and a spoiler component comprising corrugated metal plate means in front of and spaced from said shield, said spoiler plate means being generally parallel to said shield; said spoiler plate means being corrugated in zigzag form, providing individual panels that are inclined to the shield at about 45°, and convex deflector bars running along the valleys of the spoiler.

* * * * *